United States Patent [19]

Wood

[11] 4,117,925

[45] Oct. 3, 1978

[54] ARTICLE CARRIER AND BLANK THEREFOR

[75] Inventor: Prentice J. Wood, Hapeville, Ga.

[73] Assignee: The Mead Corporation, Dayton, Ohio

[21] Appl. No.: 823,588

[22] Filed: Aug. 11, 1977

[51] Int. Cl.[2] ..... B65D 5/48

[52] U.S. Cl. ..... 206/186; 206/191; 229/28 BC; 229/52 BC

[58] Field of Search ..... 229/28 BC, 52 BC, 28 R; 206/172, 180, 181, 185, 186, 187, 188, 189, 191, 428

[56] References Cited

U.S. PATENT DOCUMENTS

| | | | |
|---|---|---|---|
| 2,634,043 | 4/1953 | Arneson | 229/52 BC |
| 2,661,140 | 12/1953 | Arneson | 229/52 BC |
| 2,996,216 | 8/1961 | Gish | 206/191 |
| 3,283,949 | 11/1966 | Wysocki | 206/191 |
| 3,672,539 | 6/1972 | Forrer | 206/188 |
| 3,709,400 | 1/1973 | Arneson | 229/52 BC |
| 3,917,060 | 11/1975 | Wood | 206/191 |
| 4,000,813 | 1/1977 | Stout | 206/187 |

*Primary Examiner*—William Price

*Assistant Examiner*—Bruce H. Bernstein

*Attorney, Agent, or Firm*—Walter M. Rodgers; Walter A. Rodgers

[57] ABSTRACT

An article carrier is formed from a unitary blank and comprises a bottom wall, side walls foldably joined respectively to the side edges of the bottom wall, end wall panels foldably joined respectively to the end edges of the side walls, riser panels foldably joined respectively to the end wall panels at one end of the carrier, medial partition structure foldably joined to the end wall panels at the other end of the carrier, a handle secured at one end thereof to the riser panels and secured at the other end thereof to the medial partition structure, a hand hole disposed in the handle, and transverse partition structure struck from the medial partition structure and including an anchoring tab secured to one side wall, a transverse partition strip foldably joined to the anchoring tab, and an L-shaped medial tab foldably joined to the transverse partition strip remote from the anchoring tab and foldably joined to the medial partition structure along a fold line which is substantially adjacent the lower edge of the hand hole and which is substantially coextensive therewith.

3 Claims, 6 Drawing Figures

ARTICLE CARRIER AND BLANK THEREFOR

In the packaging of the widely utilized large primary packages such as bottles, importance is placed on the strength of the individual article carriers. In this regard the portion of the article carrier immediately below the hand hole is of critical importance and structural failure in this area can cause destruction of the carrier and attendant loss of its contents. Attempts to provide a strong and economical carrier have utilized a medial tab which is remote from the hand gripping aperture and which is not coextensive therewith so that but partial strengthening of the handle is achieved.

According to this invention an article carrier is provided and comprises a bottom wall, side walls foldably joined respectively to the side edges of the bottom wall, end wall panels foldably joined respectively to the end edges of the side walls, riser panels foldably joined respectively to the end wall panels at one end of the carrier and extending medially inward of the carrier, unitary medial partition structure foldably joined to both end wall panels at the other end of the carrier and extending medially inward of the carrier, a multiple ply handle secured at one end thereof to the upwardly extending portions of the riser panels and secured at the other end thereof to the upwardly extending portion of the medial partition structure, a hand hole disposed in the handle, and transverse partition structure struck from the medial partition structure and including an anchoring tab secured to one of the side walls, a transverse partition strip foldably joined to the anchoring tab, and an inverted L-shaped medial tab having vertical and horizontal parts and with its vertical part foldably joined to the transverse partition strip remote from the anchoring tab and with its horizontal part foldably joined to the medial partition structure, the fold line between the medial tab and the medial partition structure being substantially adjacent the lower edge of the hand hole and being substantially coextensive therewith.

Figure 1:
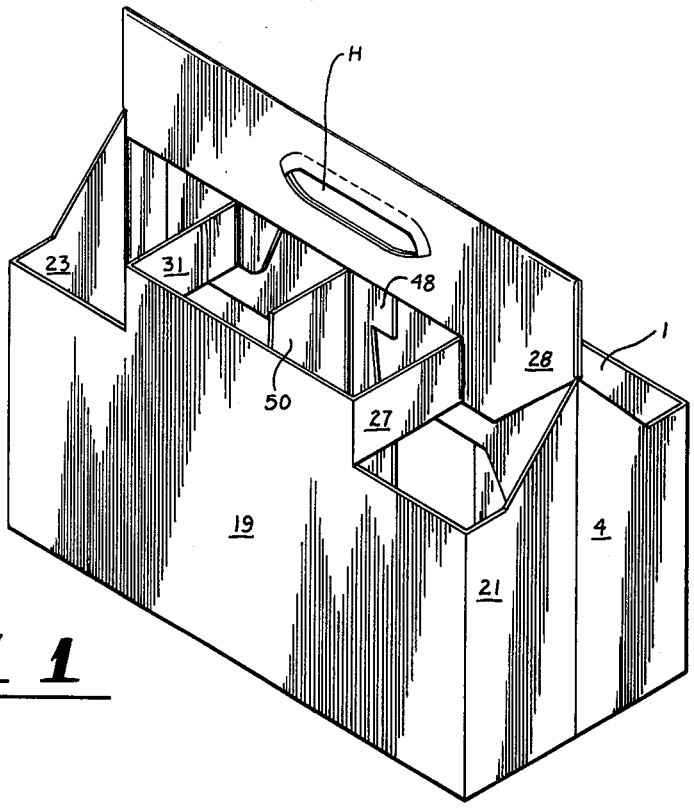
Figure 2:
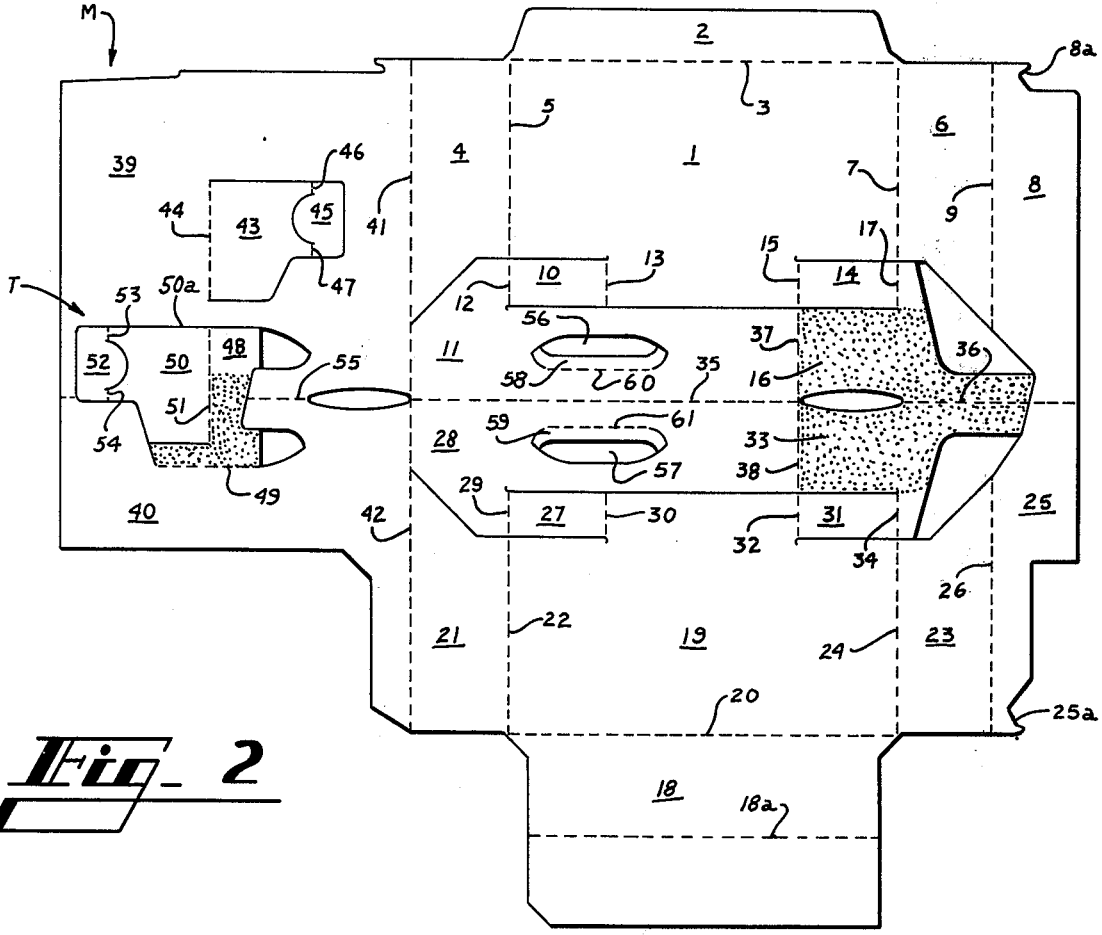
Figure 3:
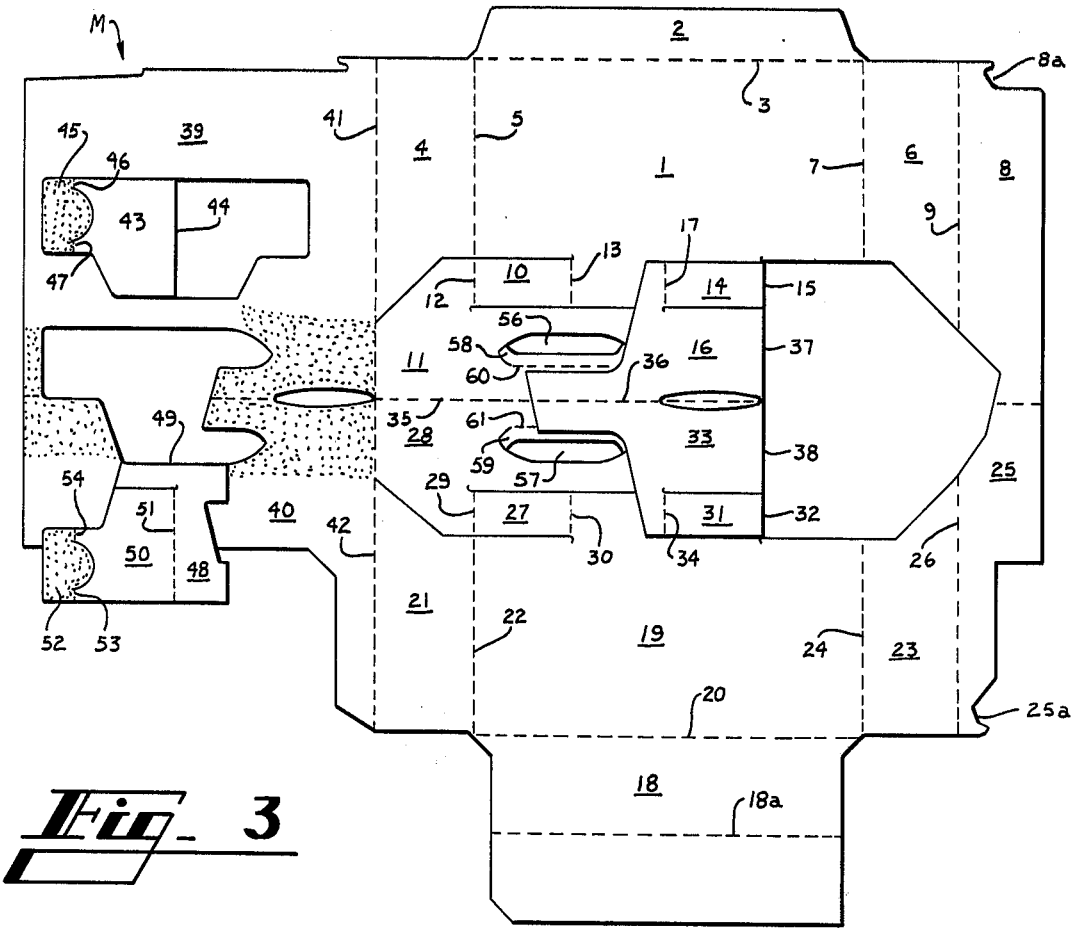
Figure 4:
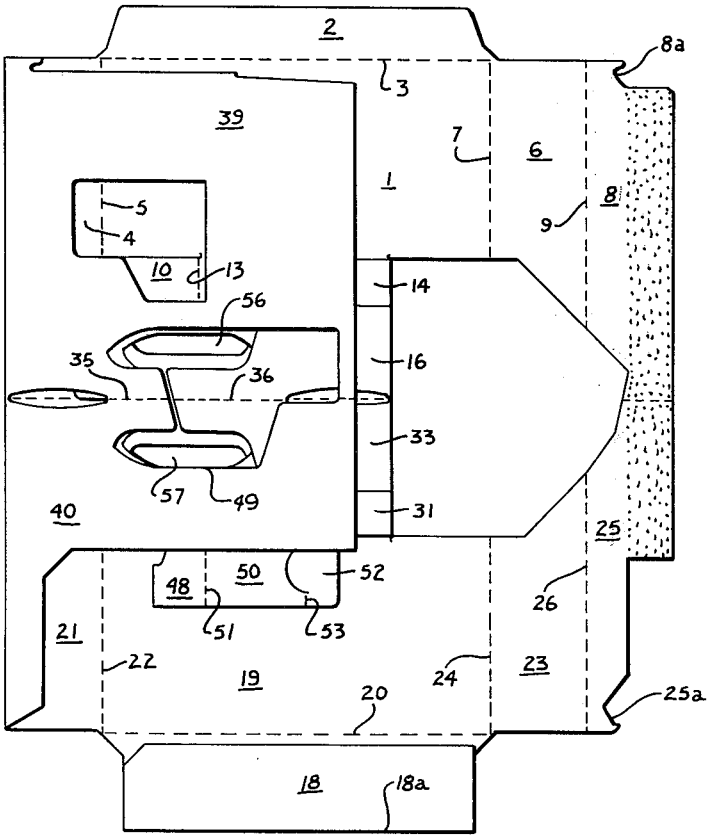
Figure 5:
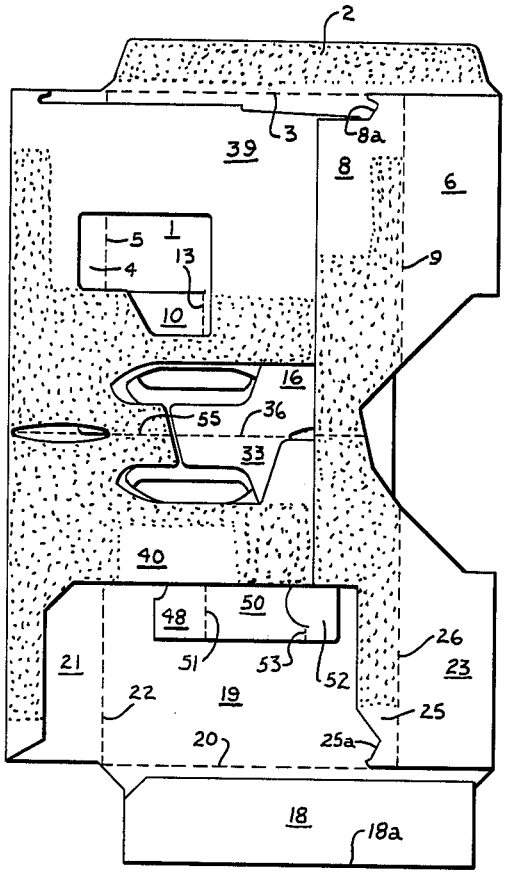
Figure 6:
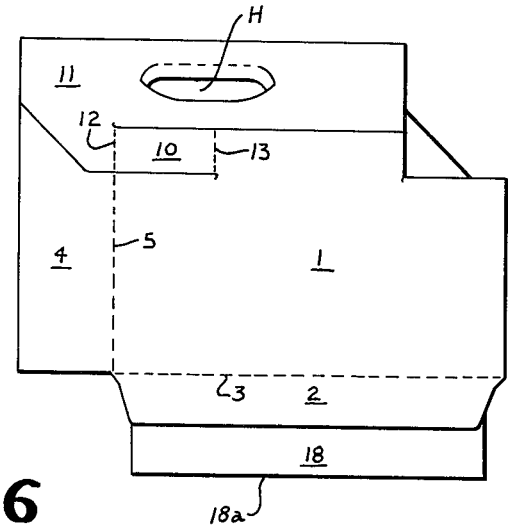

For a better understanding of the invention reference may be had to the following detailed description taken in conjunction with the accompanying drawings in which FIG. 1 is an isometric view of an erected article carrier formed according to this invention;

FIG. 2 is a plan view of a blank from which the carrier shown in FIG. 1 is formed;

FIGS. 3, 4, and 5 depict intermediate stages through which the blank of FIG. 2 is manipulated in order to form a complete and collapsed carrier as shown in FIG. 6.

In the drawings the numeral 1 represents a side wall of the carrier to the bottom edge of which a glue flap 2 is foldably joined along fold line 3. End wall panel 4 is foldably joined to an end edge of side wall 1 along fold line 5 while end wall panel 6 is foldably joined to the opposite end edge of side wall 1 along fold line 7. Riser panel 8 is foldably joined to end wall panel 6 along fold line 9 and is provided with notch 8*a*.

Partition strip 10 is foldably joined to handle panel 11 along fold line 12 and to side wall 1 along fold line 13. Partition strip 14 is foldably joined to side wall 1 along fold line 15. Also partition strip 14 is foldably joined to reinforcing panel 16 along fold line 17.

The other side of the blank is similar to that just described and includes bottom panel 18 which is foldably joined to side wall 19 along fold line 20. Bottom panel

18 is provided with medial fold line 18*a*. End wall panel 21 is foldably joined to side wall 19 along fold line 22 while end wall panel 23 is foldably joined to the opposite end of side wall 19 along fold line 24. Riser panel 25 is foldably joined to end wall panel 23 along fold line 26 and is provided with notch 25*a*.

Partition strip 27 is foldably joined to handle panel 28 along fold line 29 and to side wall 19 along fold line 30. Partition strip 31 is foldably joined to side wall 19 along fold line 32 and is foldably joined to reinforcing panel 33 along fold line 34. Also handle panels 11 and 28 are foldably joined to each other along medial fold line 35. Similarly reinforcing panels 16 and 33 are foldably joined to each other along medial fold line 36. In addition handle panels 11 and 28 are foldably joined respectively to reinforcing panels 16 and 33 along fold lines 37 and 38.

In order to provide necessary medial article separation, unitary medial partition structure is provided and is generally designated by the letter M and includes medial panels 39 and 40. Medial panel 39 is foldably joined to end wall panel 4 and to handle panel 11 along fold line 41. Similarly medial panel 40 is foldably joined to end panel 21 and to handle 28 along fold line 42.

Medial panel 39 is provided with transverse partition strip 43 and which is foldably joined to medial panel 39 along fold line 44. In addition anchoring tab 45 is foldably joined to transverse partition strip 43 along vertically coincidental fold lines 46 and 47.

Transverse partition structure is provided for the other side of the carrier and is generally designated by the letter T. More specifically transverse partition structure T is provided with L-shaped medial tab 48 which is foldably joined to medial panel 40 along fold line 49. In addition transverse partition strip 50 is foldably joined to medial tab 48 along fold line 51. Anchoring tab 52 is foldably joined to transverse partition strip 50 along vertically coincidental fold lines 53 and 54. Medial panels 39 and 40 are joined together along interrupted fold line 55.

Handle panels 11 and 28 are provided respectively with hand gripping apertures 56 and 57. Hand cushioning flaps 58 and 59 are foldably joined respectively to handle panels 11 and 28 along fold lines 60 and 61. Hand gripping apertures 56 and 57 cooperate to form hand hole H in the completed carrier as shown, for example, in FIG. 1.

According to one feature of this invention, fold line 49 is substantially aligned with the lower edge of hand gripping aperture 57 while cut line 50*a* is substantially aligned with the lower edge of hand gripping aperture 56. In addition transverse partition structure T is struck in part from medial panel 39 and is configured so that the remaining material of both medial panels provides reinforcement directly below the hand gripping apertures 56 and 57 as is apparent in FIGS. 3 and 4.

In order to form a completed carrier from the blank shown in FIG. 2, transverse partition strip 43 together with anchoring tab 45 are elevated and folded toward the left along fold line 44. In addition, glue is applied to L-shaped medial tab 48 as shown by stippling in FIG. 2 and the entire transverse partition structure T comprising L-shaped medial tab 48, transverse partition strip 50, and anchoring tab 52 is elevated and folded upwardly and over along fold line 49. In addition glue is applied to reinforcing panels 16 and 33 as shown by stippling in FIG. 2 and then reinforcing panels 16 and 33 are folded upwardly and to the left respectively along fold lines 37 and 38. The carrier then appears as shown in FIG. 3 whereby L-shaped medial tab 48 is adhered to medial panel 40 and reinforcing panels 16 and 33 are adhered respectively to handle panels 11 and 28.

Following this operation, an application of glue is made to the carrier blank as shown by stippling in FIG. 3. More specifically glue is applied to anchoring tabs 45 and 52. In addition glue is applied to medial panels 39 and 40. The entire unitary medial partition structure M is then elevated and folded to the right along fold lines 41 and 42 to occupy the position shown in FIG. 4. By this operation and according to one aspect of this invention, fold line 49 assumes a position substantially adjacent the lower edge of hand gripping aperture 57 and is substantially coextensive therewith. Also cut line 50*a* substantially coincides with hand gripping aperture 56.

Subsequently glue is applied to riser panels 8 and 25 as indicated by stippling in FIG. 4. Riser panels 8 and 25 together with end wall panels 6 and 23 are then elevated and folded toward the left along fold lines 7 and 24 to occupy the positions shown in FIG. 5. By this operation riser panels 8 and 25 are adhered respectively to medial panels 39 and 40.

Following this, an application of glue is made to medial panels 39 and 40 as well as to riser panels 8 and 25 as shown by stippling in FIG. 5. In addition bottom panel 18 is folded along medial fold line 18*a* to occupy the position shown in FIG. 5 and an application of glue is made to glue flap 2 as shown by stippling in FIG. 5. Thereafter the entire upper portion of the carrier as viewed in FIG. 5 is folded upwardly and over along fold lines 55 and 36 to occupy the position as shown in FIG. 6 which represents the completed carrier in collapsed condition.

In order to set up the carrier from its collapsed condition as shown in FIG. 6 to the erected condition shown in FIG. 1, it is simply necessary to secure side walls 1 and 19 against movement toward the right and to apply a force toward the right to the medial edges of end wall panels 4 and 21. This extends the carrier and moves the side walls apart. Simultaneously the bottom wall 18 folds into a flat plane. The carrier is maintained in erect condition by cooperation between locking notches 8*a* and 25*a* and one end of bottom wall 18. The carrier then appears as shown in FIG. 1.

It can be seen that by this invention an improved article carrier is provided which includes essentially five plys of paperboard material directly beneath the hand hole portion of the article carrier handle. Of course this added reinforcement in such a critical portion of the carrier is especially important in the transport of extremely heavy primary packages.

The embodiments of the invention in which an exclusive property or privilege is claimed are defined as follows:

1. An article carrier comprising a bottom wall, side walls foldably joined respectively to the side edges of said bottom wall, end wall panels foldably joined respectively to the end edges of said side walls, a riser panel foldably joined respectively to the associated end wall panel at one end of the carrier and extending medially inward of the carrier, medial partition structure foldably joined to the end wall panels at the other end of the carrier and extending medially inward of the carrier, a multiple ply handle secured at one end thereof to the upwardly extending portion of said riser panel and secured at the other end thereof to the upwardly extending portion of said medial partition structure, a hand hole disposed in said handle, and transverse partition structure struck from said medial partition structure and including an anchoring tab secured to one of said side walls, a transverse partition strip foldably joined to said anchoring tab, and an inverted L-shaped medial tab having vertical and horizontal parts and with its vertical part foldably joined to said transverse partition strip remote from said anchoring tab and with its horizontal part foldably joined to said medial partition structure along a horizontal fold line, the fold line between said medial tab and said medial partition structure being substantially adjacent the lower edge of said hand hole and being substantially coextensive therewith.

2. An article carrier according to claim 1 wherein a second anchoring tab is secured to the other of said side walls and wherein a second transverse partition strip is foldably joined to said second anchoring tab at one end thereof and is foldably joined to said medial partition structure at the other end thereof.

3. An article carrier blank comprising a bottom panel, a first side wall foldably joined to a side edge of said bottom panel, a first pair of end wall panels foldably joined respectively to the end edges of said first side wall, a first medial panel foldably joined to one of said first pair of end wall panels remote from said first side wall, a handle panel foldably joined to said first medial panel, a hand gripping aperture formed in said handle panel, a second medial panel foldably joined to said first medial panel, one of a second pair of end wall panels foldably joined to said second medial panel, a second side wall foldably joined to said one of a second pair of end wall panels remote from said second medial panel, the other of said second pair of end wall panels foldably joined to said second side wall remote from said one of said second pair of end wall panels, transverse partition structure struck from said medial panels and being foldably joined to said first medial panel along a horizontal fold line, and said horizontal fold line being substantially parallel to the lower edge of said hand gripping aperture.

* * * * *